US011965409B2

(12) United States Patent
Baklanov et al.

(10) Patent No.: US 11,965,409 B2
(45) Date of Patent: Apr. 23, 2024

(54) DOWNHOLE DEVICE COMMUNICATION USING MEASURED ELECTRICAL PROPERTY OF SUPPLIED POWER

(71) Applicant: Schlumberger Technology Corporation, Sugar Land, TX (US)

(72) Inventors: Nikolay Baklanov, Sugar Land, TX (US); Xuedong Yang, Sugar Land, TX (US); Maxim Klyuzhev, Houston, TX (US); Benjamin Jean Yvon Durand, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 40 days.

(21) Appl. No.: 17/656,708

(22) Filed: Mar. 28, 2022

(65) Prior Publication Data

US 2023/0304390 A1 Sep. 28, 2023

(51) Int. Cl.
*E21B 44/02* (2006.01)
*E21B 47/12* (2012.01)

(52) U.S. Cl.
CPC ..... *E21B 44/02* (2013.01); *E21B 47/12* (2013.01)

(58) Field of Classification Search
CPC ..... E21B 44/02; E21B 44/00; E21B 47/12
See application file for complete search history.

(56) References Cited

U.S. PATENT DOCUMENTS

| | | | | |
|---|---|---|---|---|
| 5,572,182 | A | 11/1996 | De Pinho Filho et al. | |
| 5,670,931 | A | 9/1997 | Besser et al. | |
| 6,712,160 | B1 * | 3/2004 | Schultz | E21B 41/0085 175/48 |
| 2003/0024710 | A1 * | 2/2003 | Post | E21B 23/04 166/66.4 |
| 2005/0281680 | A1 | 12/2005 | Schulz | |
| 2017/0023695 | A1 * | 1/2017 | Zhang | E21B 47/12 |
| 2020/0408087 | A1 * | 12/2020 | Hagen | E21B 17/003 |

FOREIGN PATENT DOCUMENTS

WO 9716751 A1 5/1997

OTHER PUBLICATIONS

International Search Report and Written Opinion issued in International Patent application PCT/US2023/016378 dated Jul. 14, 2023, 11 pages.

* cited by examiner

*Primary Examiner* — Caroline N Butcher
(74) *Attorney, Agent, or Firm* — Jeffrey D. Frantz

(57) ABSTRACT

A measured electrical property may be used to control operation of a downhole device, which may be at least partially supported by additional downhole measurements consumed by the downhole device. For example, a downhole device may include an electrical sensor that measures an electrical property of electrical power provided to the downhole device. A processor of the downhole device may convert the measured electrical property to a quantized electrical property and determine a command or control action that corresponds to the quantized electrical property. The command or control action may be implemented to control operation of the downhole device.

12 Claims, 14 Drawing Sheets

DOWNHOLE DEVICE COMMUNICATION USING MEASURED ELECTRICAL PROPERTY OF SUPPLIED POWER

BACKGROUND OF THE INVENTION

The present disclosure relates generally to downhole tools and more specifically to techniques for controlling downhole devices.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Producing hydrocarbons from a wellbore drilled into a geological formation is a remarkably complex endeavor. During certain operations, such as well production operations, downhole devices such as tractors, sensors, and safety valves are disposed downhole. At least in some instances, the downhole devices may be at least partially controlled by a control system disposed on the surface (e.g., a surface control system). In general, the surface control system may communicate with the downhole devices via a wired connection. However, at least in some instances, information transmitted via the wired connection may be distorted due to downhole properties such that a message received by the downhole device may not correspond to the message transmitted by the surface control system. Furthermore, it may be difficult to establish communication between one or more downhole properties via a physical connection due to physical constraints downhole (e.g., relatively small cross sectional areas).

SUMMARY OF THE INVENTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, the present disclosure relates to a system having a surface power supply configured to supply power to a downhole device. The system also includes the downhole device, wherein the downhole device is configured to operate using the supplied power, detect an electrical parameter of the supplied power, and change an operating state of the downhole device based at least in part on the electrical parameter.

In certain embodiments, the present disclosure relates to a downhole device including one or more processors and one or more memory comprising instructions stored on a non-transitory computer-readable medium and executable by the one or more processors to measure an electrical property of electrical power provided to the downhole device; convert the measured electrical property to a quantized electrical property; determine an operational adjustment based on the quantized electrical property via reference data stored on a storage component associated with the downhole device; and modify operation of the downhole device based on the operational adjustment.

In certain embodiments, the present disclosure relates to a non-transitory computer-readable medium comprising computer-executable instructions that, when executed, are configured to cause a processor to receive a measured electrical property of electric power provided to a downhole device via a power supply; convert the measured electrical property into a quantized electrical property; generate an operational adjustment output based on the quantized electrical property via reference data stored on a storage component associated with the downhole device; provide the operational adjustment output to a scripted state machine; and modify operation of downhole device, using the scripted state machine, based on the operational adjustment output and a current operating state of the downhole device.

In certain embodiments, the present disclosure relates to a system. The system includes one or more processors. The system also includes one or more memory comprising non-transitory computer-readable medium comprising computer-executable instructions that, when executed, are configured to cause the one or more processors to measure an electrical property of electric power provided to a downhole device; determine one or more calibration coefficients associated with a downhole condition based on the measured electrical property; determine a quantized electrical property based on the measured electrical property and the one or more calibration coefficients; determine an operational adjustment based on the quantized electrical property; and modify operation of the downhole device based on the operational adjustment.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
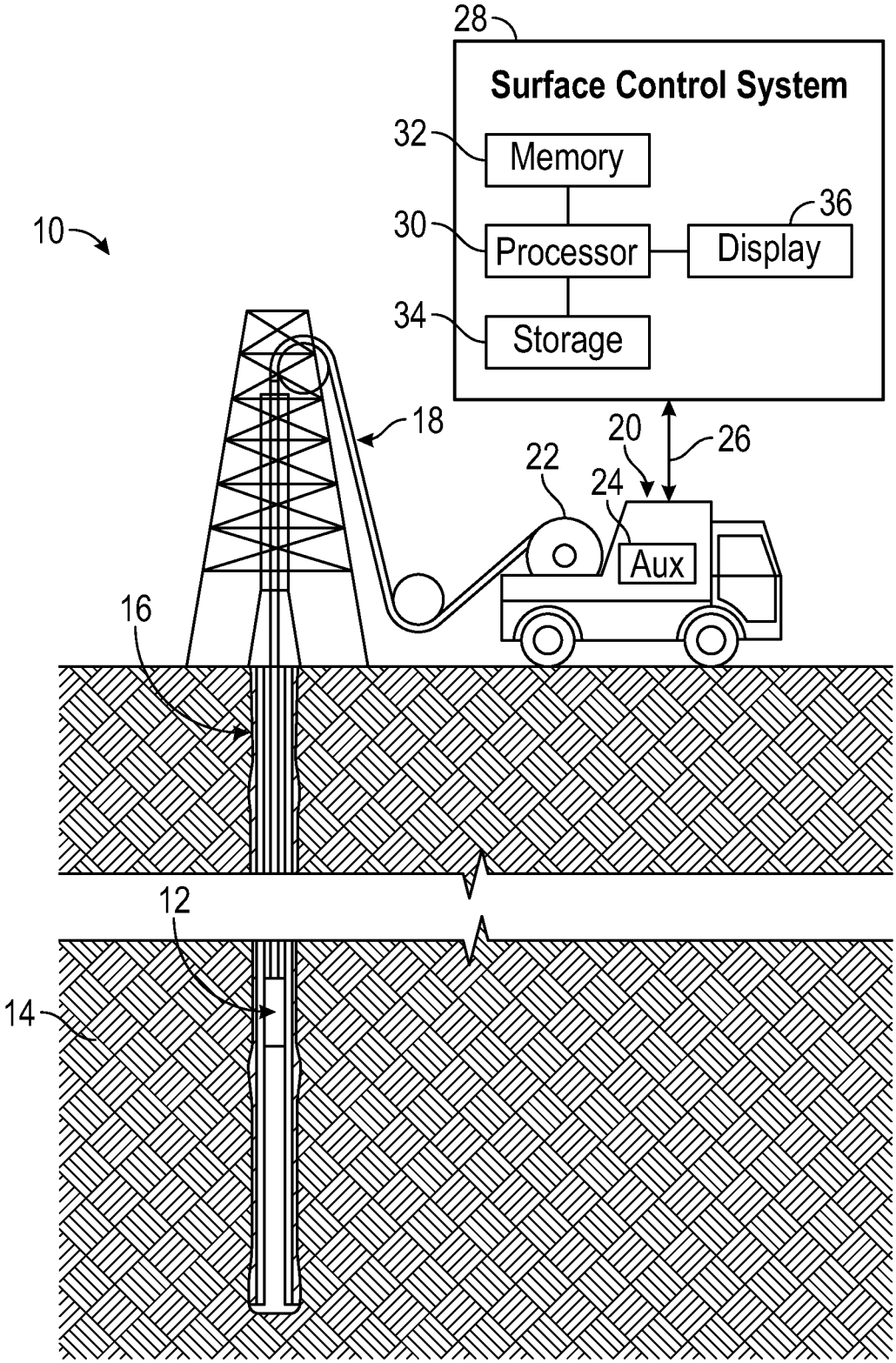
FIG. 1 is a partial cross-sectional view of an example of a downhole tool having one or more downhole devices that are suspended into a subsurface formation, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

As generally discussed above, downhole devices (e.g., components having a processor capable of determining control actions) may communicate with a control system disposed on the surface (e.g., a surface control system). At least in some instances, downhole devices may communicate with the surface control system via telemetry (e.g., mud pulse telemetry). However, certain techniques for telemetry may utilize additional components to transmit and receive commands via a geological formation. At least in some instance, the communication between the control system and the downhole devices may be impeded due to control signals being distorted due to properties downhole. It is presently recognized that it may be advantageous to communicate between a surface and one or more downhole devices using changes in electronic properties of electric power provided to the one or more downhole devices. For example, such communication may reduce the number of components utilized for communicating between the surface and the downhole devices (e.g., not using a transmitter, a receiver, or a wire for communicating electromagnetic waves).

Accordingly, the present disclosure is directed to techniques for improving communication between a surface control system and a downhole device using a measured electrical property. In general, the downhole device may include a processor that is capable of performing analysis of signals transmitted by the surface control system. The processor of the downhole device may communicate with a surface control system using electrical property measurements of the power provided to the downhole devices from the surface control system. For example, the surface control system may output a control signal that modifies (e.g., increases or decreases) a voltage supplied to a downhole device. The downhole device may include an electrical property sensor capable of measuring the electrical property related to the electronic power (e.g., the current and/or the voltage) The processor of the downhole device may receive the voltage measurement, determine a control action that corresponds to the voltage, and adjust operation of the downhole device accordingly. Furthermore, it is presently recognized that the voltage supplied to the downhole device may be modified unexpectedly (e.g., not as a result of the surface control system increasing or decreasing the voltage) due to electronic components turning on, off, or operation that are electrically coupled to the voltage. For example, a resistance of a logging cable in between the surface control system and the downhole device may vary due to a component, such as a motor, turning on or off. At least in some instances, the surface control system may adjust its power supply output voltage based on a measurement of current and/or input (e.g., user input indicating prior knowledge) indicating the cable resistance. As such, the processor of the downhole device may identify an expected voltage or quantized voltage that corresponds to an expected voltage (i.e., that is not modified unexpectedly) supplied to the downhole device. In this way, the downhole device may more accurately determine control actions to implement despite unexpected variations in the supplied voltage that may occur as a result of factors downhole (i.e., other electrical components, downhole conditions). Moreover, by controlling the downhole device based on variations in a supplied voltage, multiple devices may be controlled by a single transmission.

With the foregoing in mind, FIG. 1 illustrates a well-logging system 10 that may employ the systems and methods of this disclosure. The well-logging system 10 may be used to convey a downhole device 12 through a geological formation 14 via a borehole 16. In the example of FIG. 1, the downhole device 12 is conveyed on a cable 18 via a logging winch system (e.g., vehicle 20). Although the vehicle 20 is schematically shown in FIG. 1 as a mobile logging winch system carried by a truck, the vehicle 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the vehicle 20 and/or the downhole device 12.

In general, the downhole device 12 is an electronic device that is electrically coupled to receive a voltage supplied from the surface. In some embodiments, the downhole device 12 may be communicatively coupled to a surface control system 28. For example, data signals 26 may be transmitted from the surface control system 28 to the downhole device 12, and the data signals may be related to the spectroscopy results may be returned to the surface control system 28 from the downhole device 12, additionally, the data signals 26 may include control signals. The surface control system 28 may be any electronic data processing system that can be used to carry out the systems and methods of this disclosure. For example, the surface control system 28 may include a processor 30, which may execute instructions stored in memory 32 and/or storage 34. As such, the memory 32 and/or the storage 34 of the surface control system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display images generated by the processor 30. The surface control system 28 may be a local component of the vehicle 20 (e.g., within the downhole device 12), a remote device that analyzes data from other vehicles 20, a device located proximate to the drilling operation, or any combination thereof. In some embodiments, the surface control system 28 may be a mobile computing device (e.g., tablet, smart phone, or laptop) or a server remote from the vehicle 20. As shown in the illustrated embodiment, the surface control system also includes a power supply 58 that is generally used to provide power to the components of the downhole device 12 via the logging cable 18, as discussed in more detail herein.

The downhole device 12 includes an electronic device having a processor and memory that is capable of performing control actions. In some embodiments, the downhole device may include sensors for formation and/or production measurements, a tractor for conveyance, or include mechanical mechanisms to operate completion control elements, such as sliding sleeves, safety valves, and the like. For example, the downhole device 12 may include a sensor, such as a downhole tool; however, it should be appreciated that any suitable conveyance may be used. For example, the downhole device may be a tractor or any suitable downhole tool that may perform a variety of operations downhole. For example, the downhole device may traverse the borehole 16 or may obtain measurements of the geological formation 14 using a sensor (e.g., a neutron sensor, an x-ray or gamma-ray spectroscopy sensor, an image sensor such as a camera). In some embodiments, the downhole device 12 may be a safety valve, a downhole tractor, drilling tools (i.e., non-wireline), acquisition/sampling tools or other devices having components that may be mechanically actuated based on control signals (e.g., generated by the downhole device 12).

In general, the downhole device 12 may include generally similar features as the surface control system 28. For example, the downhole device may include a processor, which may execute instructions stored in memory and/or storage. As such, the memory and/or the storage of the downhole device 12 may be any suitable article of manufacture that can store the instructions. The memory and/or the storage may be read-only memory (ROM), random-access memory (RAM), flash memory, an optical storage medium, or a hard disk drive, to name a few examples. The processor, memory, and/or storage may be a local component of the downhole device (e.g., within a housing of the downhole device 12).

Figure 2:
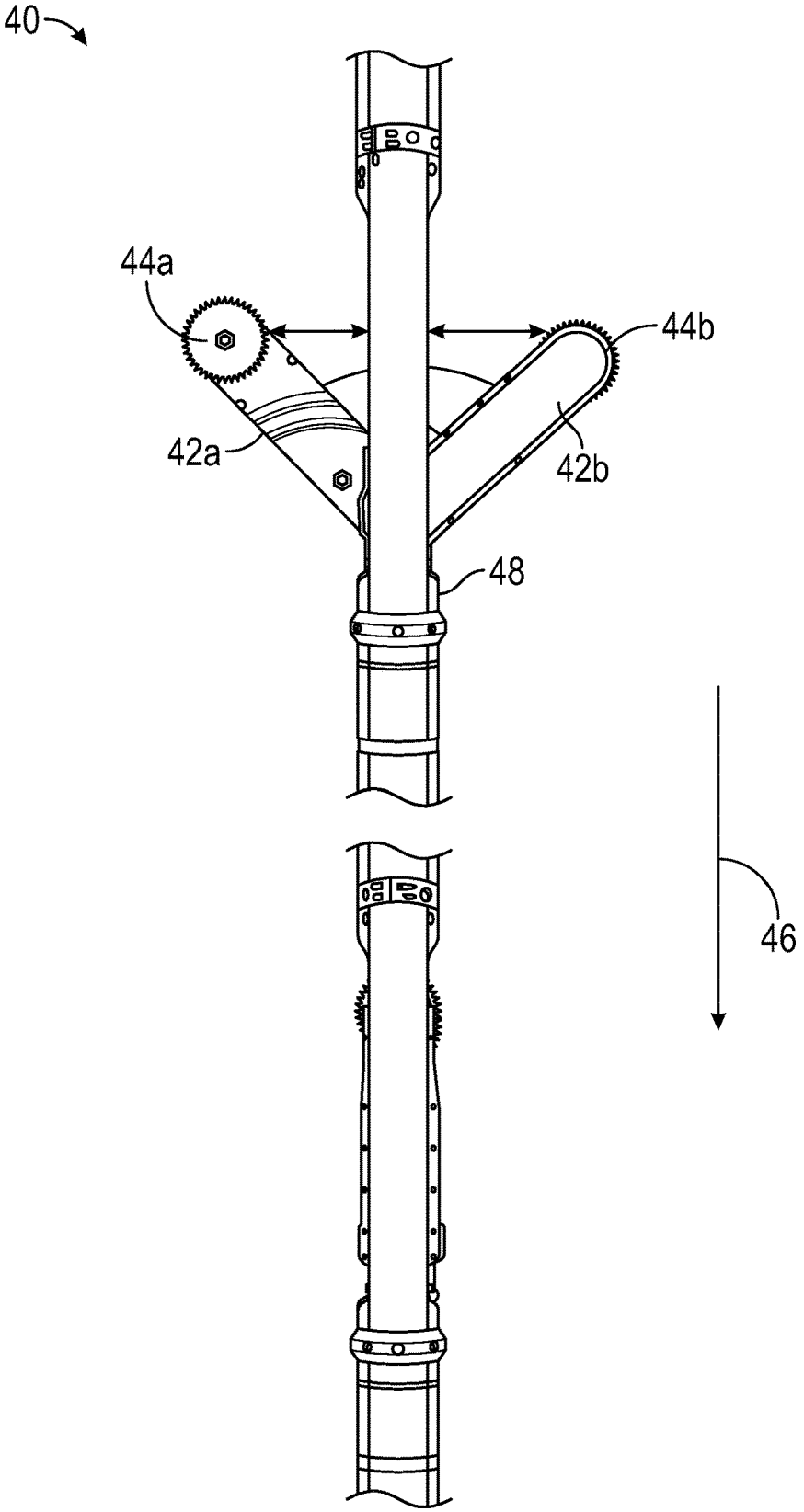
FIG. 2 is a partial cross-sectional view of a downhole tractor that may be included as one of the one or more downhole devices of FIG. 1, in accordance with an aspect of the present disclosure.

As noted above, in some embodiments, the downhole device 12 may be a downhole tractor device capable of facilitating movement of one or more downhole devices or other components within the borehole 16. In some embodiments, the downhole tractor device may operate autonomously and/or semi-autonomously (e.g., based on commands or instructions received from the surface control system 28. For example, the downhole device 12 may be a tandem tractor that includes self-identification capabilities (e.g., identification of operational states or anomalies such as restriction identification), and provides the identified operational state(s) to the surface control system 28. Providing the identified operational state to the surface control system 28 may inform an operator of the tandem tractor and/or enable the surface control system 28 to provide proactive actions to control operation of the downhole device. To illustrate this, FIG. 2 illustrates a downhole tractor device 40 representing an example of a downhole device 12 that includes navigation components that enable the downhole tractor device 40 to move through a well, regardless of the orientation of the well (e.g., to traverse horizontal wells, diagonal wells, and vertical wells). In this illustrated embodiment, the downhole tractor device 40 includes one or more extending arms 42*a*, 42*b*. Each extending arm 42*a*, 42*b* includes a wheel 44*a*, 44*b* that facilitates movement of the downhole device 12 in the direction of travel 46. In the illustrated embodiment, each extending arm 42*a*, 42*b* is pivotally coupled to the body 48 of the downhole tractor device 40. Accordingly, the first extending arm 42*a* and second extending arm 42*b* may be configured to fold up relative to the body 48 to reduce the lateral width of the downhole tractor device 40 to permit, for example, transportation of the implement through relatively narrow regions of the wellbore, such as a restriction.

Figure 3:
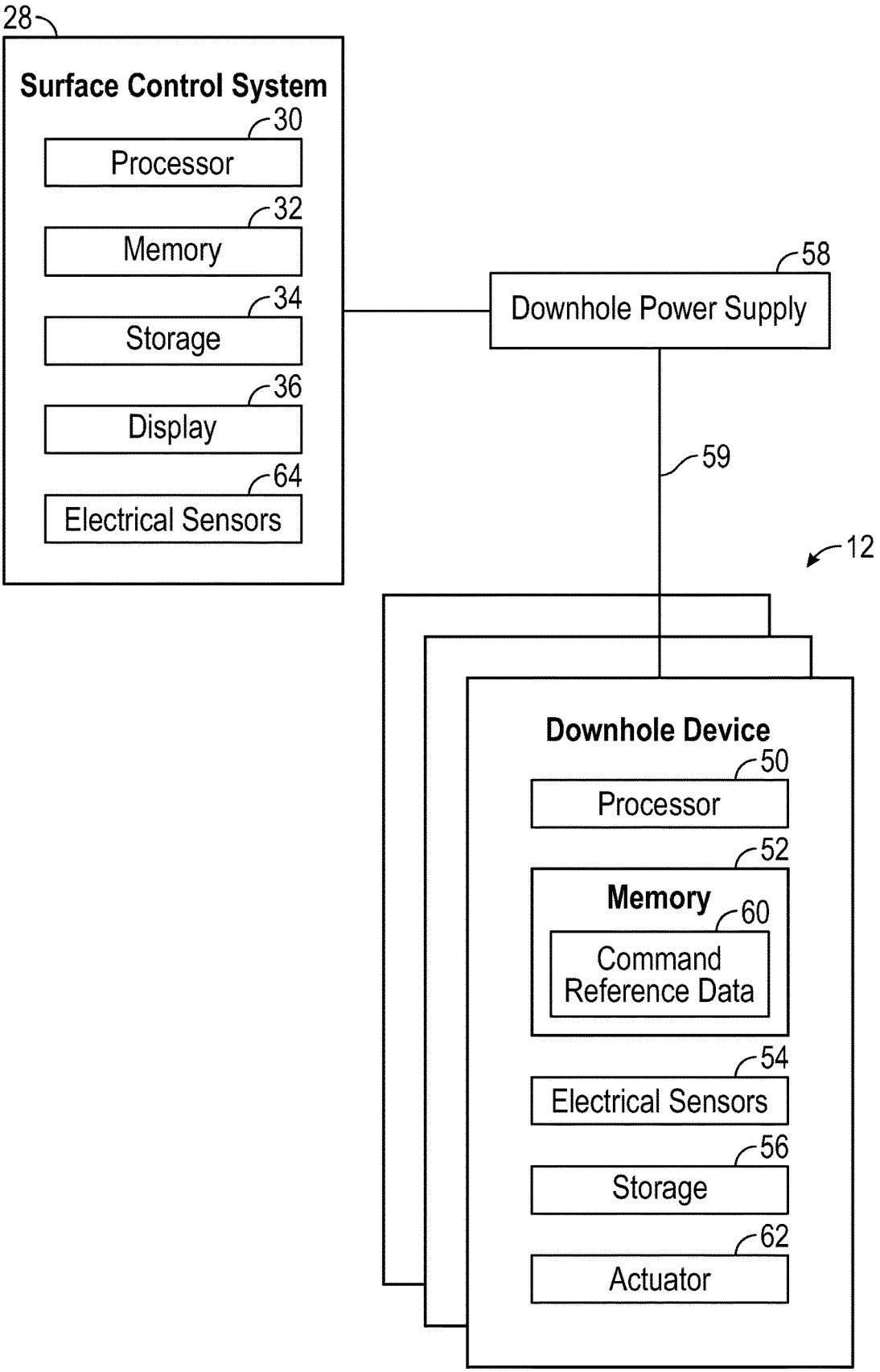
FIG. 3 illustrates a block diagram of a surface control system that is coupled to a downhole device, in accordance with an aspect of the present disclosure.

Operation of downhole devices 12, such as the downhole tractor device 40 described above, may be controlled by a processor of the downhole device 12, as described in more detail with respect to FIG. 3, that is generally downhole with the downhole tractor device 40 whereas the surface control system 28 remains on the surface. The processor may be stored within a body of the downhole device 12 (e.g., the body 48 of the downhole tractor device 40) or outside of the body of the downhole device 12. In any case, operation of the downhole device 12 may be controlled directly by the processor based on communication between the processor and the surface control system 28.

FIG. 3 illustrates a block diagram of the surface control system 28 that is communicatively coupled to the downhole device 12. In the illustrated embodiment, the downhole device 12 includes a processor 50, memory 52, electrical property sensors 54, and storage 56. In some embodiments, the processor 50 may be ASIC (application specific integrated circuit), field programmable gate array (FPGA), a micro control unit (MCU), a digital signal processor (DSP), and the like. In general, the downhole device 12 communicates with the surface control system 28 via a downhole power supply 58. The downhole power supply may be disposed on the surface while providing power to the downhole device 12 while the downhole device 12 is downhole. More specifically, the processor 30 of the surface control system 28 may be capable of modifying a voltage supplied by the downhole power supply 58 to the downhole devices 12. In general, the downhole power supply 58 may be disposed on the surface. A logging cable 59 may be provided between the surface control system 28 including the downhole power supply 58 and the downhole device 12. That is, the surface control system 28 may include the downhole power supply 58. In some embodiments, operational adjustments by the downhole device 12 could completely or partially assisted by changes in the voltage measured by the downhole device 12 and/or consumed/ interpreted by the downhole device 12 to change its operating state. Thus, the downhole device 12 may be capable of operating automatously or partially (e.g., semi) automatously. As described herein, modification of the voltage supplied by the downhole power supply 58 may be used to convey instructions between the surface control system 28 in the downhole device 12. For example, the processor 30 of the surface control system 28 may output a control signal that causes a decrease in the voltage supplied by the downhole power supply 58. In turn, the electrical property sensors 54 of the downhole device 12 may identify the decrease in voltage by measuring the voltage supplied to the downhole device 12. In the illustrated embodiment, the memory 52 may store command reference data 60. As described in more detail herein, the processor 50 of the downhole device 12 may determine a command that corresponds to the measured voltage and output control signal that modifies operation of the downhole device based on the determined command. Further, the illustrated embodiment of the downhole device 12 includes actuators 62. In general, the actuators 62 may actuate one or more machine components (e.g., valves, pistons, sensors, extending arms, and the like) of the downhole device 12 based on control signals provided by the processor 50. Furthermore, the surface control system 28 may also include electrical property sensors 54, which operate in a generally similar manner as the electrical property sensors 54 of the downhole device 12.

Figure 4:
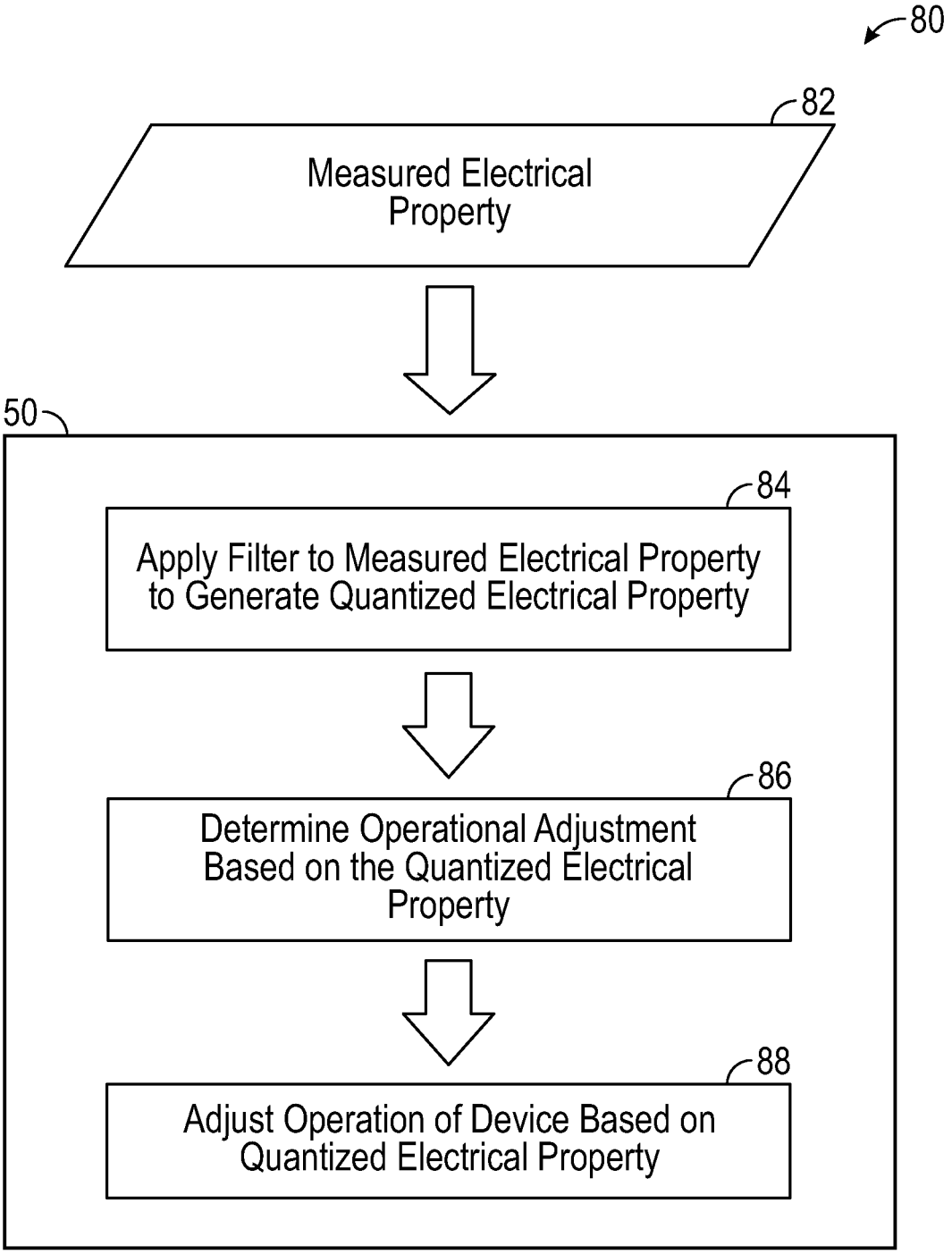
FIG. 4 illustrates a flow chart of a method for determining operational adjustments to control downhole devices based on electrical property data, in accordance with an aspect of the present disclosure.

As described herein, the downhole device 12 may be capable of determining control actions based on electrical property data transmitted from the surface. To illustrate this, FIG. 4 illustrates a flowchart of a method 80 that may be implemented by a processor 50 of the downhole device 12 for modifying operation of the downhole device 12 based on a measured electrical voltage provided to the downhole device 12. Although the method 80 has been described as being performed by the processor 50, it should be noted that any suitable processing device may perform the method 80, such as the processor 30 of the surface control system.

As shown in FIG. 4, the processor 50 may acquire a measured electrical property 82, such as a measured voltage or current related to electrical power provided to the downhole device 12. In some embodiments, the electrical property 82 may be measured via electrical property sensors (e.g., the electrical property sensors 54 as described above with respect to FIG. 3). In some embodiments, the downhole device 12 and/or the downhole device controller may be communicatively coupled to an electrical property sensor capable of measuring a voltage, current, or any other electrical property. For example, the electrical property sensors may be electrically coupled to a power supply of one or more of the downhole devices 12, such as a high voltage direct current (HVDC) supplied to the one or more downhole devices 12.

At block 84, the processor 50 may convert the electrical property data to quantized electrical property data. In general, to convert the electrical property to quantized electrical property data, the processor 50 may determine whether a measured voltage corresponds to an expected voltage supplied from a power supply on the surface. For example, as discussed above, the voltage supplied to the downhole devices 12 may be unexpectedly modified due to certain occurrences downhole, such as the operation of other electrical components within the borehole 16 powered by the supplied voltage. As such, the processor 50 may determine an expected voltage based on the measured voltage to reduce potential errors in the determination of a control signal based on the supply voltage.

As one non-limiting example, the processor 50 may receive measured voltage data over a time period, and the measured voltage data may include an amount of noise. The processor 50 may identify a trend within the measured voltage data, such as by determining the average voltage during the time period. For example, the processor 50 may determine whether the letter voltage data is increasing decreasing or staying relatively constant during the time. In any case, the processor 50 may use the average voltage data as the quantized electrical property data.

At block 86, the processor 50 may determine an operational adjustment that corresponds to the quantized electrical property data. In general, the memory 52 of the downhole device may store data indicative of a relationship between a quantized electrical property data and a command for an operational adjustments. For example, the memory 52 may store reference data or a reference table (e.g., the command reference data 60 as described above with respect to FIG. 3) that identifies commands corresponding to certain quantized or expected voltages, as described in more detail with respect to FIG. 5.

At block 88, the processor 50 may adjust operation of the downhole device 12 based on the quantized electrical property. For example, the processor 50 may output a control signal that causes an actuator to actuate, thereby modifying a position of a mechanical component of the downhole device 12.

Accordingly, by utilizing electrical property data to determine operational adjustments for the downhole device, the disclosed techniques reduce (e.g., in some cases, help to minimize) the number of components that are disposed downhole (e.g., the downhole device may not include components such as a dedicated communications wire and/or a network communications device, such as a modem) thereby reducing the footprint of the downhole devices. Moreover, by converting the electrical property data to quantized electrical property data and using the quantized electrical property data to determine operational adjustments, the downhole device may reduce (e.g., minimize) errors in determined operational adjustments that may result from fluctuations in the electrical property data that result from downhole conditions.

Figure 5:
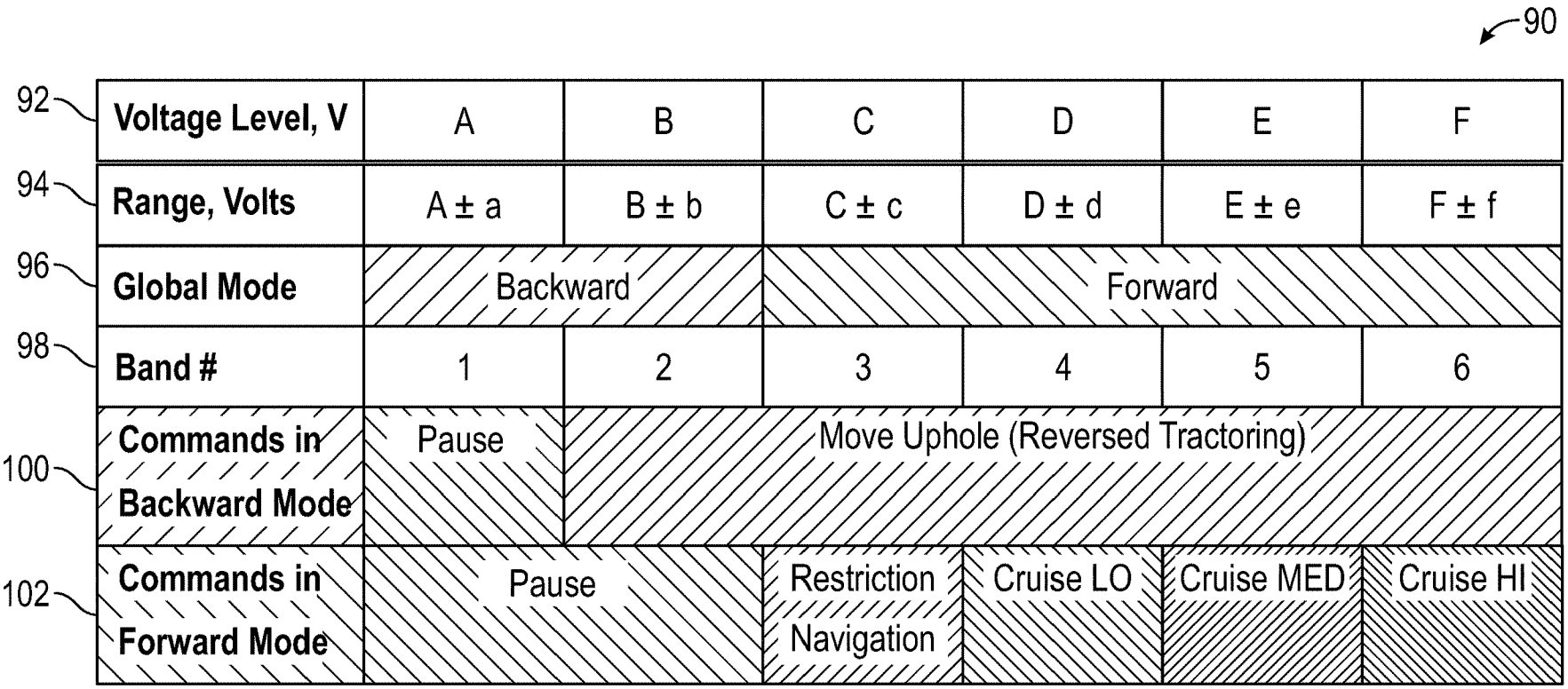
FIG. 5 shows a table storing operational commands that may be associated with certain quantized electrical property data, in accordance with an aspect of the present disclosure.

To illustrate stored data indicative of a relationship between a quantized electrical property data and a command for an operational adjustments, FIG. 5 shows a table 90 storing records (e.g., rows) associated with different types of data that may be utilized by the processor 50 to determine operational adjustments based on quantized electrical property data. It should be noted that one or more multiple tables may be used to store operational adjustments and/or commands used to control the downhole device 12. For example, the memory 52 of the downhole device 12 may include a table storing commands for maintaining control patterns of the arms (e.g., the arms 42) and for providing the control patterns as a feed (e.g., a resource file) into a scripted state machine. In the illustrated embodiment, the table 90 includes a quantized voltage record 92 a voltage range record 94, a global navigation record 96, a quantized band assignment record 98, a backwards command record 100, and a forwards command record 102. In general, the table 90 stores records that may be useful in processing electrical property data (e.g., determining a number of different number of commands to divide the electrical property data into) and/or determining the operational adjustments. It should be noted that while six records are shown in the table 90, in some embodiments, the table may include fewer or more records. For example, the table 90 may only include the quantized voltage record 92, the backwards command record 100, and the forwards command record 102. In some embodiments, the voltages in the voltage record 92 may corresponds to voltages greater than 100V, between 200 V and 400V, between 400 V and 600 V, between 450 V and 650 V, and greater than 650 V. While the range in the voltage range record 94 is shown as being ±15 V, it should be noted that the range may be any suitable range, such as ±5 V, ±10 V, ±30 V, or ±50V.

With respect to the global navigation record 96, the processor 50 may determine an assigned band based on the current global mode. For example, the processor 50 may receive an input indicative of the global mode and determine band assignments based on the global mode. For example, if the global mode is forward, the processor 50 may select bands that operate within the current global mode rather than transitioning between different global modes.

Accordingly, in an embodiment where the processor 50 utilizes the table 90 of FIG. 5 to perform the method 80 of FIG. 4, the processor 50 may receive a measured electrical property, determine an expected range of the electrical property, determine a number of commands for controlling the downhole device, determine a number of bands based on the number of commands and the range, and utilize the number of bands for quantizing subsequent measured electrical property data or data sets.

Figure 6:
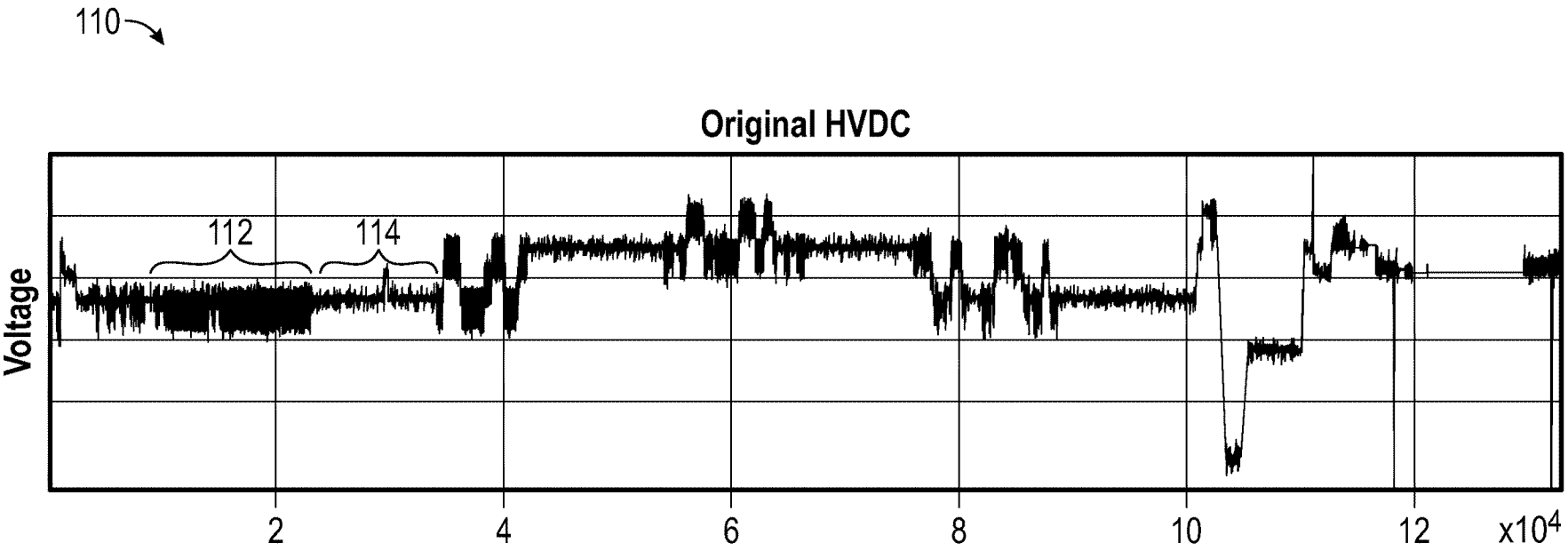
FIG. 6 illustrates a graph of electrical property data that may be assessed by a processor of a downhole device, in accordance with an aspect of the present disclosure.
Figure 7:
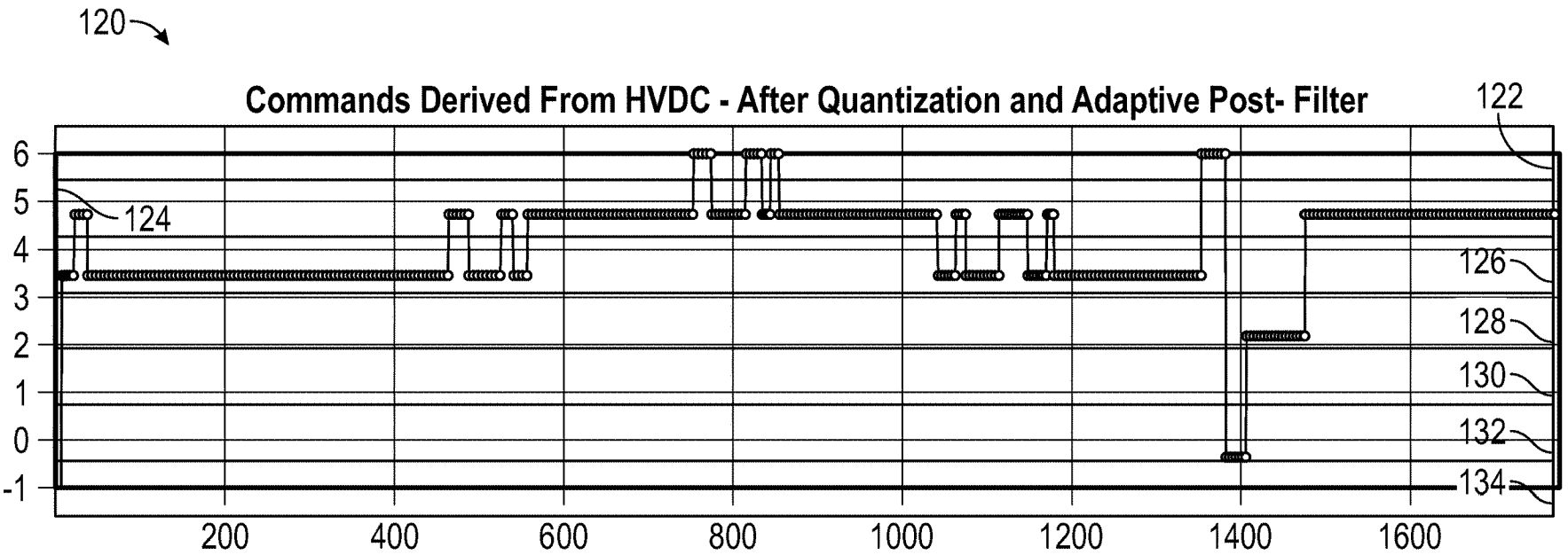
FIG. 7 illustrates a graph of quantized electrical property data that may be used to control operations of a downhole device, in accordance with an aspect of the present disclosure.

To further illustrate the differences in the electrical property data and the quantized electrical property data, FIGS. 6 and 7 show graphs generated based on a measured electrical property (e.g., voltage). FIG. 6 shows a graph 110 of voltage supplied as high voltage direct current. In general, the voltage over a given time period may include noise that, at least in some instances, having a relatively large magnitude. For example, a first region 112 (e.g., first time period) may include a signal-to-noise ratio (SNR) that is relatively higher than the SNR of a second region 114 (e.g., second time period). Accordingly, without processing the measured voltage shown in FIG. 6, the processor 50 of the downhole device 12 could incorrectly assign a measured voltage within the first region 112 as being different from a measured voltage with the second region 114, although the voltage provided by the surface control system 28 for each region may be the same. Under such conditions, the downhole device 12 could determine an operational adjustment that would not correspond to the expected voltage output by the downhole power supply 58 (e.g., generated based on control signals provided by the surface control system 28).

FIG. 7 shows a graph 120 of quantized voltage generated using the measured electrical property of FIG. 6. To illustrate the quantized voltage, the graph 120 includes bands 122, 124, 126, 128, 130, 132, and 134. In general, each band of the bands 122, 124, 126, 128, 130, 132, and 134 includes a range of voltages (e.g., a subset of the range of voltages depicted on the graph 120). Accordingly, the quantized voltage is a voltage representative of a measured voltage that is within the range of voltages. For example, referring briefly to FIG. 6, a first voltage (e.g., a first average voltage or a first expected voltage) within the first region 112 and a second voltage (e.g., a second average voltage or a second expected voltage) within the second region 114 each fall within the band 126. Accordingly, the processor 50 may determine that the measured voltage within the first region 112 and the second region 114 correspond to the same quantized voltage.

Figure 8:
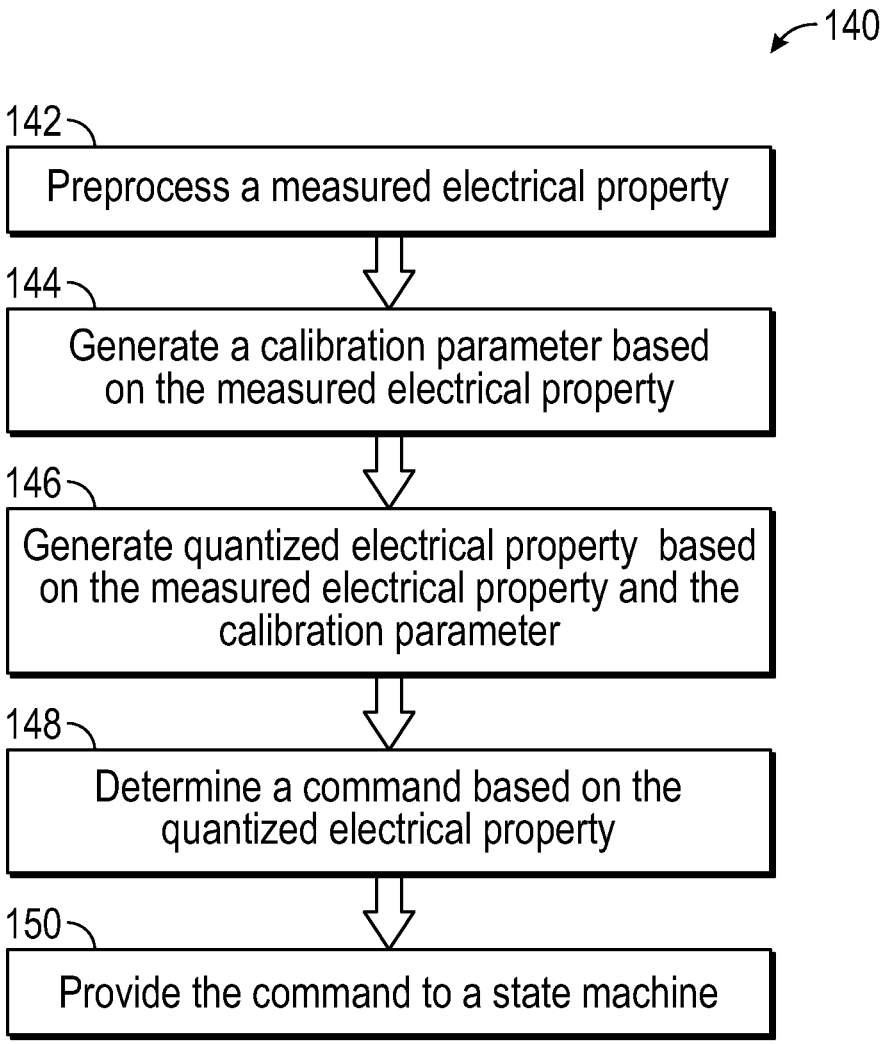
FIG. 8 illustrates a flow chart of a method for determining a command or control action to be implemented by a downhole device based on a measured electrical property, in accordance with an aspect of the present disclosure.

As one non-limiting example of a technique for determining a quantized electrical property, FIG. 8 illustrates a flow chart of a method 140 that may be implemented by the processor 50 of the downhole device 12 for determining the quantized electrical property.

At block 142, the processor 50 may pre-process a measured electrical property (e.g., the measured electrical property 82 described with respect to FIG. 4). In some embodiments, the measured electrical property (e.g., HVDC) may be combined with a first data indicating load variations and/or a second data indicating electromagnetic interference (EMI) are combined to pre-process the data. In some embodiments, pre-processing the measured electrical property may include applying a moving filter (e.g., filter at a frequency such as 5 Hz, 10 Hz, 15 Hz, or 20 Hz, or suitable frequency associated with machine noise), using techniques such as root mean square (RMS) filter, a rectifier circuit, and/or a peak to peak (P2P) detector.

In some embodiments, the processor 50 may utilized multi-scale filters, such as a first filter that filters frequencies greater than 10 kHz, greater than 12 kHz, greater than 14 kHz, or greater than 20 kHz to remove motor EMI and rectify quasi-DC high voltage superimposed with sinusoidal EMI. In an embodiment using a median filter and a high-speed filter, before engaging the median filter, and after high-speed filter, the rectified signal may be decimated from 10 kHz to low frequency to reduce processor load and keep timing scale indicative of slower mechanical processes. Then system applies median filtering at 5 Hz, 10 Hz, 15 Hz, or 20 Hz, or suitable frequency to get rid of statistically insignificant outliers and local variation, followed by down-sampling through averaging of the cleaned signal. Resultant time-series of such filtered electrical property is a reliable representation of the trend of changes of the 'property' buried in the noise and at rates less demanding to the computing power.

In any case, the pre-processed data may include a denoised output (e.g., 'quasi DC'). In some embodiments, pre-processing the measured electrical property may include providing the measured electrical property to a decimator which may apply a filter similar to a frequency associated with telemetry (e.g., 5 Hz, 10 Hz, or 15 Hz). The output of the decimator at block 148 may be sliced in accordance with an input period (e.g., 1 s, 2 s, 3 s, 4 s, 5 s, or more than 5 s) (e.g., provided as user input). In some embodiments, pre-preprocessing the measured electrical property may include receiving an adjustable window size that may be used to control the period.

Figure 16:
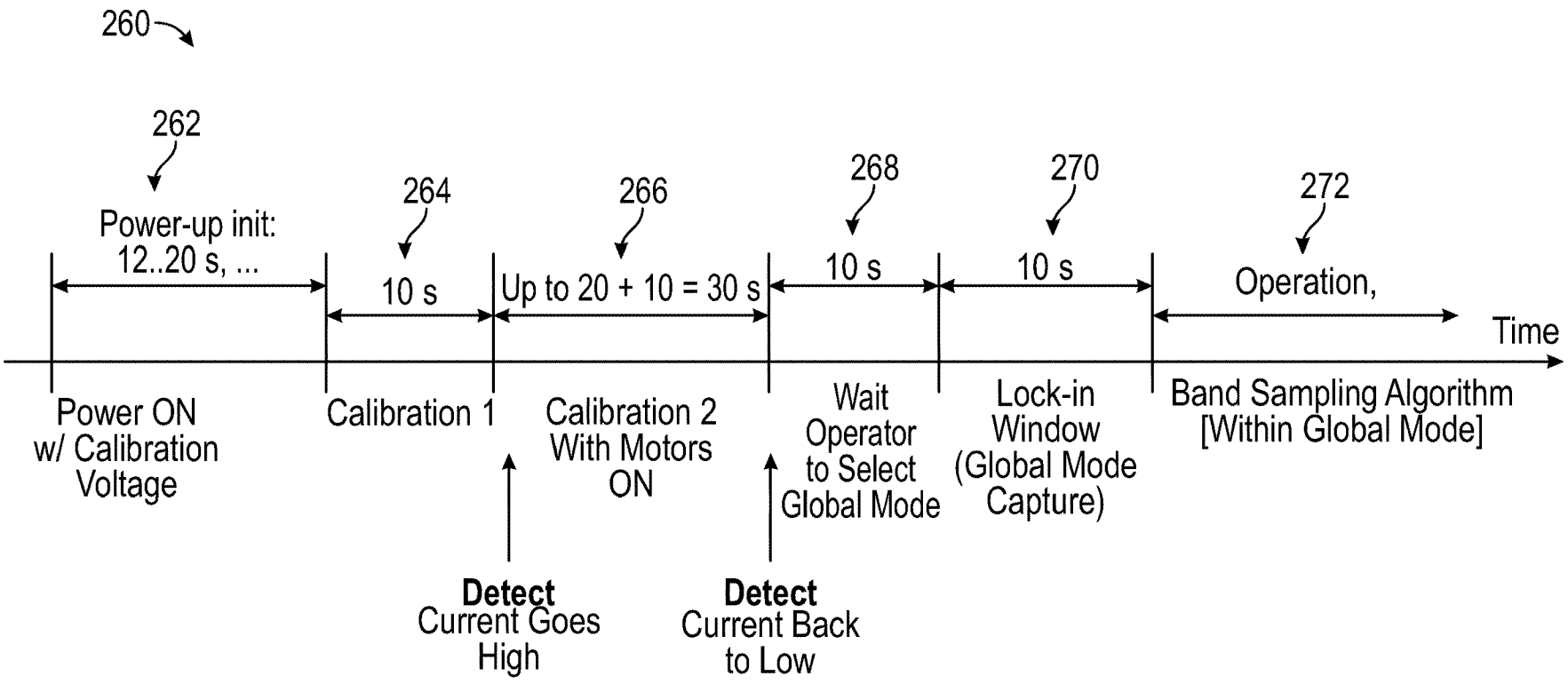
FIG. 16 illustrates a block diagram of example operation states, in accordance with an embodiment.

At block 144, the processor 50 may utilize the pre-processed the measured electrical property to generate one or more calibration coefficients. In general, the calibration coefficients (e.g., A1, A2) represent the occurrence or absence of certain downhole conditions. Examples of certain calibration phases that may be used in the calculation of the calibration coefficients are shown in FIG. 16, discussed in further detail below. For example, A1 may represent a coefficient that scales a magnitude of an electrical property based on electrical components not being activated downhole (e.g., no RPM). In this example, A2 may represent a coefficient that scales a magnitude of an electrical property based on electrical components (e.g., a motor) being activated downhole (e.g., RPM load). In some embodiments, the pre-processed measured electrical property may be provided to a selection device (e.g., a multiplexer (MUX)), and an electrical property output of the selection device may be used during a calibration of the downhole device 12 to generate the calibration coefficients. In some embodiments, a calibration step (e.g., generating the calibration coefficients at block 144) may be repeated, such as in an example where downhole conditions have changed from initial downhole conditions. For example, the processor 50 may receive an input indicating fluctuations of temperature. As such, the processor 50 may repeat the step at block 144 subsequent to receiving the indication of downhole conditions changing due to temperature.

At block 146, the processor 50 may generate a quantized electrical property in a generally similar manner as described with respect to block 84 of FIG. 4. At block 148, the processor 50 may determine a command based on the quantized electrical property in a generally similar manner as described with respect to block 86 of FIG. 4. At least in some instances, at block 150, the processor 50 may provide the commands to a scripted state machine (e.g., as described in more detail with respect to FIG. 13) to provide control of the downhole device 12 without little to no control provided from the surface control system 28, or another controller at the surface. For example, the commands may be provided into an intelligent quantizer that determines an operational phase based on the operating levels of the downhole device. The output of the intelligent quantizer may be provided to a filter, and a change detector (e.g., which determines whether the current band is different than a previous band). In any case, the determined band based on the operating levels are provided to the scripted state machine, which determines a command or control action based on the current operating state of the downhole device 12. In some embodiments, the filter that receives the output of the intelligent quantizer may include a non-linear novel filter with memory that is capable of filtering out fluctuations such as a short-living out-of-band deviation. Additionally, the filter may be capable of resetting decision logic if the band remains substantially the same (e.g., the processor 50 determines that the band has not changed since the previously determined band) when an accumulated out-of-band time exceeds a duration threshold.

In some embodiments, the change detector may include smart or self-learning capabilities. For example, the change detector may include a smart nature and perform gradient analysis of the slew rate and up/down trend of a quantized signal (e.g., the quantized electrical property), which may protect the filter's (e.g., the filter including a non-linear novel filter with memory) output build-up against sustained ramping up or down signal. That is, if the filter (e.g., utilized by the processor 50) observes or identifies a continuously changing band number, the processor 50 may ignore the band switch for a time duration corresponding to when the dynamic changes stabilize within a new band.

In some embodiments, the filter may operate cooperatively with the change detector (e.g., a built-in change detector). At least in some instances, the filter and the change detector provide further processing of the quantized signal, rather than processing the electrical property. For example, the intelligent quantizer may output a band to the filter, which outputs a stabilized band to the change detector. In such an example, the filter may handle out-of-band walking that result from, abnormal electrical property spike that was not handled by a previous denoising filter, downhole tool load variations such as those localized within relatively short time durations (e.g. during tractoring), up/down voltage level corrections made by the surface power supply (e.g., based on user input or otherwise to provide a forgiveness to user-guided control mode, and the like.

In some embodiments, the electrical property output of the selection device in combination with at least one of the calibration coefficients may be provided to a quantizer to determine a band associated with the electrical property. That is, the quantized may map the electrical property to a band. In some embodiments, mapping may be implemented via a loadable software template supported by the downhole device 12. For example, the memory 52 of the device 12 may store instructions, that when executed by the processor 50, cause the processor 50 to map a received electrical property to a band. Further, an adaptive post filter may be applied to correct an unexpected band assignment. The corrected band may be output to the command selection circuit, which determines a command associated with the band, such as by using a table described with respect to FIG. 5.

Figure 9:
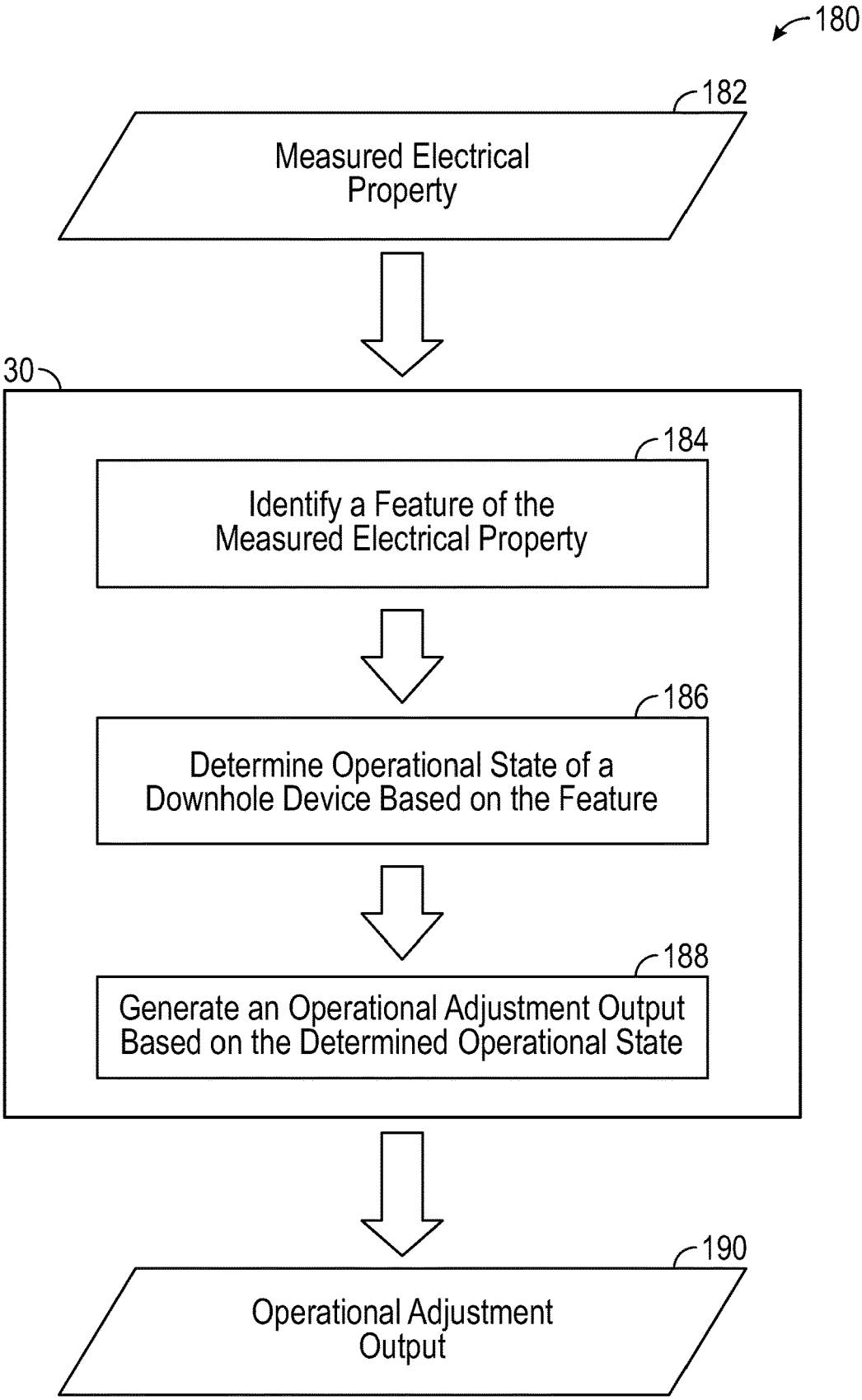
FIG. 9 illustrates a flow chart of a method for determining operational adjustments to control downhole devices based on electrical property data, in accordance with an aspect of the present disclosure.

At least in some instances, features in the electrical property data may be utilized to determine a condition of the downhole device, which may further be utilized to determine an operational adjustment based on the condition. To further illustrate this, FIG. 9 illustrates a flowchart of a method 180 that may be implemented by a processor 30 of the surface control system 28 for generating an operational adjustment output based on an identified feature in a measured electrical property. While the method 180 is described as being performed by the processor 30, it should be noted that the method 180 may also be performed by the processor 50 of the downhole device 12.

Referring to FIG. 9, at block 182, the processor 30 may receive a measured electrical property, such as a measured current, resistance, and/or voltage associated with the downhole power supply 58 that is provided to the downhole devices 12. At block 184, the processor 30 may identify a feature of the measured electrical property. In general, the feature may include a set of changes over a time period that differs from an expected set of changes. For example, the set of changes may include a drop in a measured current that is greater than an expected drop in a measured current corresponding to an electronic device being activated. Accordingly, the drop in the measured current may be indicative of an event or operational phases occurring downhole, such as a downhole device 12 stalling, a downhole device 12 performing a calibration phase, a downhole device 12 encountering or navigating a restriction, or other events that may be difficult to observe downhole.

At block 186, the processor 30 may determine the operational state, the event, or both based on the identified feature. In general, the operational state indicates a current operation of the downhole device 12, such as an "off state", a "moving forward state", a "calibration state", a "navigating restriction state", and the like. For example, the operational state may be a velocity or an acceleration of the downhole device 12.

At block 188, the processor 30 may generate an operational adjustment output based on the determined operational state, the event, or both. In general, the operational adjustment output may include an indication of a modification to operation of the downhole device 12 that may be made to remedy the event. For example, if the event is the downhole device 12 encountering a restriction, the operational adjustment output may include a control signal that causes an actuator to modify a position of extending arms of a tractor, as described above with respect to FIG. 2. As such, the processor 30 may output the control signal (e.g., the operational adjustment output 190) to cause the actuator to modify a position of an extending arm. For example, the processor 30 may output a control signal to an external processor (e.g., the processor 50 of the downhole device 12).

Figure 10:
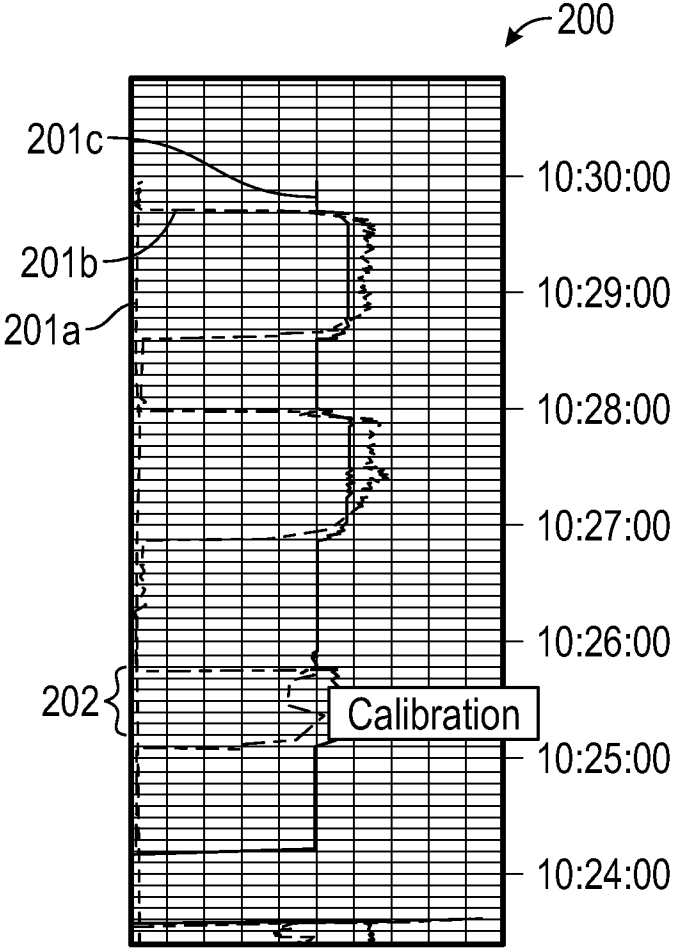
FIG. 10 shows a graph of electrical property data including a feature indicating calibration of a downhole device, in accordance with an aspect of the present disclosure.

To further illustrate the features described above, FIGS. 10-13 illustrate graphs of a measured electrical property including features. FIG. 10 shows a graph 200 of measured calibration (e.g., reference or baseline) signal 201*a*, a voltage feedback 201*b*, and surface current 201*c* versus time.

The graph 200 includes a feature 202 characterized by a dip in the measured current and/or voltage. Accordingly, the processor 30 may identify the feature and determine that the feature 202 corresponds to an event, such as a calibration process of the downhole device 12, or output a notification indicating the feature 202 to a computing device of a user or operator such that the user may provide an input to assign to the feature to an event. It should be noted that, in some instances, calibration may or may not have an indicating features. For example, the processor 50 may implement a 2-stage calibration where the first stage is silent and is timer-based. The 2nd stage may be associated with identifying signals resulting from running motor and such has the indication through current signature.

Figure 11:
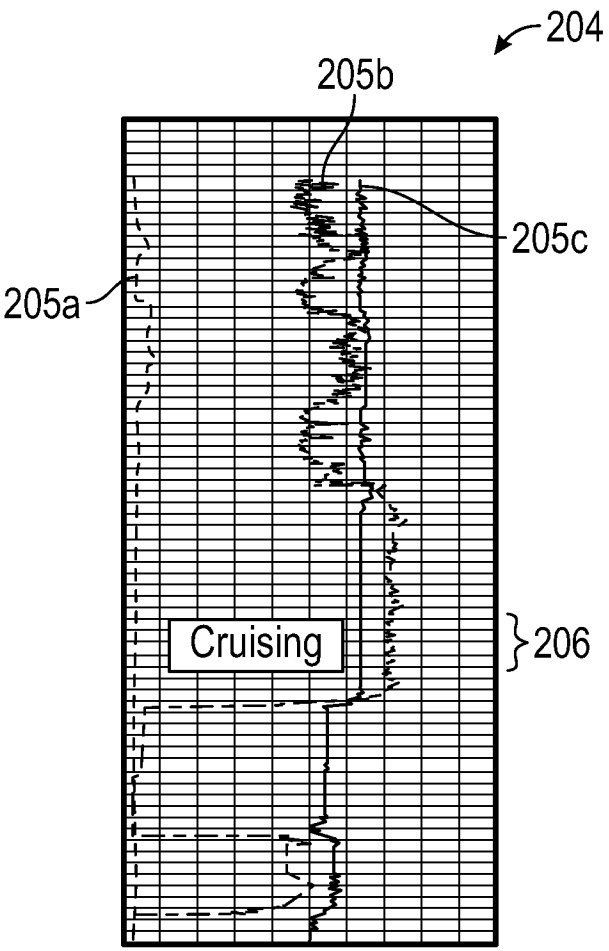
FIG. 11 shows a graph of electrical property data including a feature indicating a downhole device traversing a wellbore, in accordance with an aspect of the present disclosure.

FIG. 11 shows a graph 204 of measured calibration signal 205*a*, a voltage feedback 205*b*, and surface current 205*c* versus time. The graph 204 includes a feature 206 characterized by relatively unchanging measured current and/or voltage. Accordingly, the processor 30 may identify the feature and determine that the feature 206 corresponds to an event, such the downhole device 12 cruising or traversing without being impeded, or output a notification indicating the feature 206 to a computing device of a user or operator to assign to the feature to an event.

Figure 12:
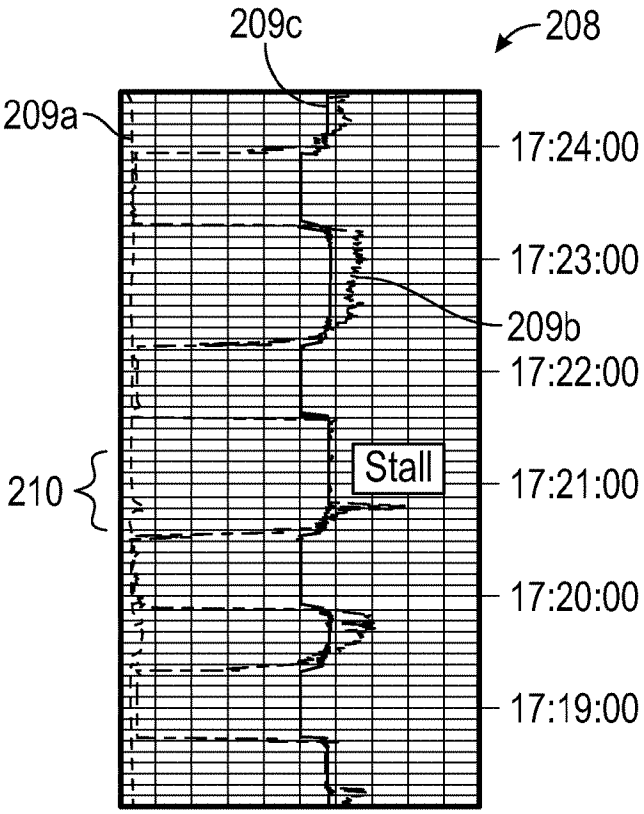
FIG. 12 shows a graph of electrical property data including a feature indicating a downhole device stall, in accordance with an aspect of the present disclosure.

FIG. 12 shows a graph 208 of measured calibration signal 209*a*, a voltage feedback 209*b*, and surface current 209*c* versus time. The graph 208 includes a feature 210 characterized by a spike in the measured current and/or voltage. Accordingly, the processor 30 may identify the feature and determine that the feature 210 corresponds to an event, such as a calibration process of the downhole device 12, or output a notification indicating the feature 210 to a computing device of a user or operator to assign to the feature to an event.

Figure 13:
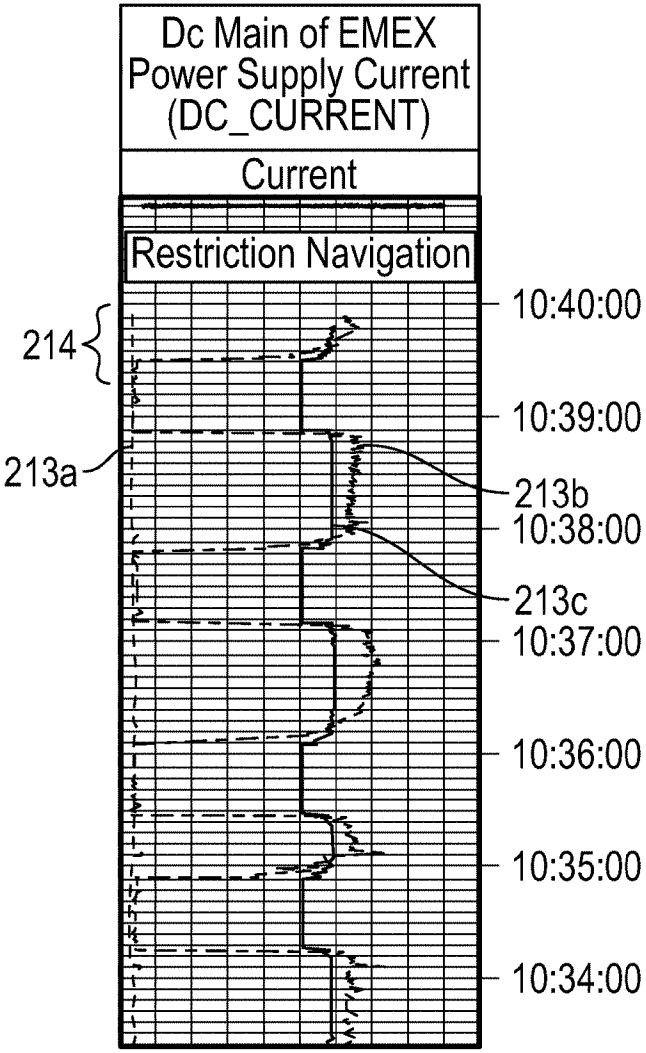
FIG. 13 shows a graph of electrical property data including a feature indicating a downhole device navigating a restriction, in accordance with an aspect of the present disclosure.

FIG. 13 shows a graph 212 of measured calibration signal 213*a*, a voltage feedback 213*b*, and surface current 213*c* versus time. The graph 212 includes a feature 214 characterized by relatively large decrease in the measured current and/or voltage. Accordingly, the processor 30 may identify the feature and determine that the feature 214 corresponds to an event, such as a calibration process of the downhole device 12, or output a notification indicating the feature 214 to a computing device of a user or operator to assign to the feature to an event.

Figure 14:
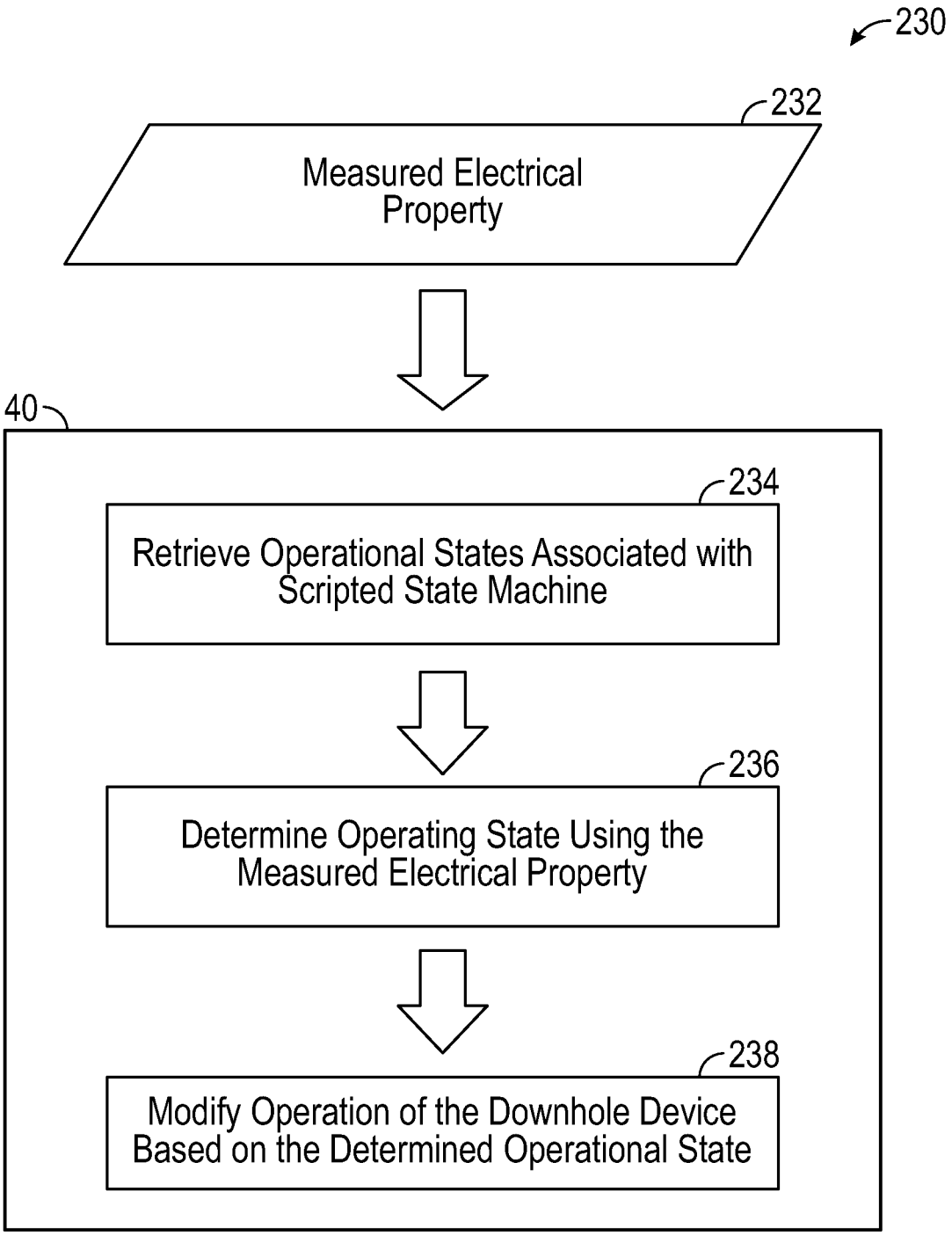
FIG. 14 illustrates a flow chart of a method for a scripted state machine (SSM), in accordance with an aspect of the present disclosure.

In some embodiments, a scripted state machine may be used to control certain operations of the downhole device 12. To illustrate this, FIG. 14 illustrates a flowchart of a method 230 that may be implemented by a processor 50 of the downhole device 12 for controlling operation of the downhole device 12 in accordance with a scripted state machine. In general, the scripted state machine may be an electronic entity, such as a software application, loadable into the memory 52 of the downhole device 12. In some embodiments, the scripted state machine may be a nested scripted state machines. The scripted state machine may receive one or more operational states based on a user input (e.g., a list of operational states of the downhole device 12). At block 232, the processor 50 may receive a measured electrical property in a generally similar manner as described with respect to FIG. 4. At block 234, the processor 50 may retrieve operational states associated with the downhole device 12 utilizing the scripted state machine. At block 236, the processor 50 may determine an operating state (e.g., as described with respect to the command selection circuit 142 of FIG. 8) to implement for the downhole device 12 using the electrical property and the operational states. For example, the processor 50 may determine a current operating state of the downhole device 12 and then determine a command based on the current operational state (e.g., as described with respect to blocks 144, 146, 148, and 150 of FIG. 8). At block 238, the processor 50 may modify operation of the downhole device 12 in accordance with the determined operational state.

Figure 15:
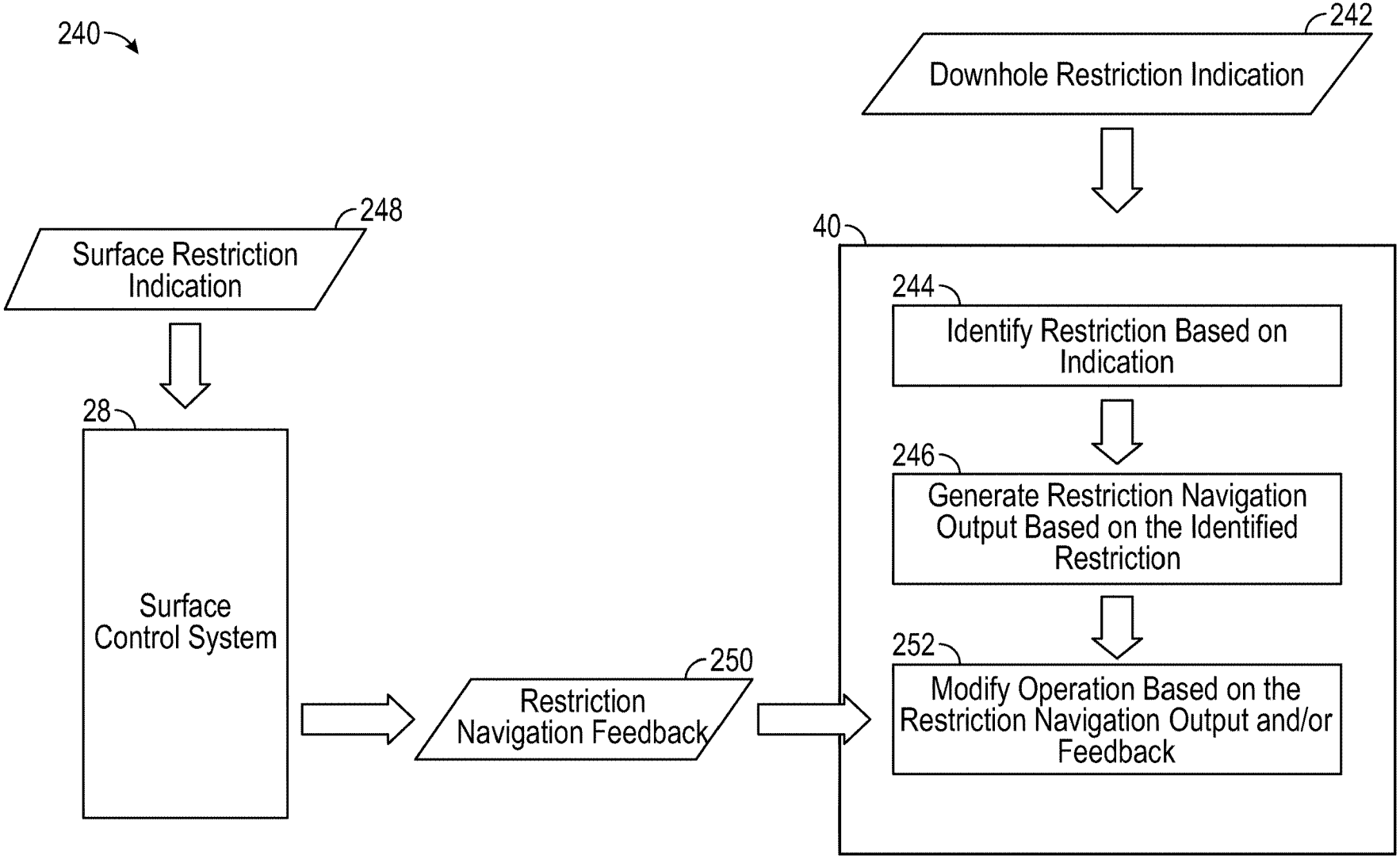
FIG. 15 illustrates a flow chart of a method for controlling operation of a downhole device based on an identified restriction, in accordance with an embodiment.

As described, the processor 50 of the downhole device 12 may be capable of determining events, such as based on a change in a measured electrical property. FIG. 15 illustrates a flowchart of a method 240 that may be implemented by a processor 50 of the downhole device 12 for modifying operation of the downhole device 12 (e.g., one or more machine components of the downhole device 12) based on an identified restriction. While the method 240 is described as being performed by the processor 30, it should be noted that the method 240 may also be performed by the processor 50 of the downhole device 12.

Referring to FIG. 15, the processor 50 may receive a downhole restriction indication 242 that indicates an occurrence of a restriction. As generally discussed herein, the indication may be related to an expected restriction (e.g. corresponding to a particular depth or time) or unexpected (e.g., determined based on patterns or features in measured voltage and/or current). In some embodiments, the indication may correspond to a depth or time measurement indicating an expected depth or expected time when the downhole device 12 is expected to encounter a restriction. For example, the memory 52 of the downhole device 12 may store the expected depth or time, and the downhole device 12 may acquire depth or time measurements while downhole. Accordingly, when the depth or time measurements are within a threshold range or match the expected depth of time, the processor 50 may receive the indication. In some embodiments, the indication may be an identified feature in measured electrical property, such as a magnitude of decrease in the measured electrical property greater than a reference magnitude decrease in the measured electrical property. At block 244, the processor 50 may identify the restriction using the indication. For example, the processor 50 a distance or time until the downhole device 12 encounters the restriction and/or determine that the downhole device 12 is currently encountering the restriction.

At block 246, the processor 50 may generate a restriction navigation output based on the identified restriction. In general, the operational adjustment output may include an indication of a modification to operation of the downhole device 12 that may be made to navigate the restriction. For example, the restriction navigation output may comprise instructions of a magnitude to adjust the extending arms of a downhole tractor device to pass through the restriction. In some embodiments, the processor 30 may receive a surface restriction indication 248. In general, the processor 30 may receive the surface restriction indication 248 based on measurements performed via the electrical sensors 64 of the surface control system 28. For example, the electrical sensors 64 may detect a change in current along the electrical connection supplying electrical power from the downhole power supply 58 that is measurable by the surface control system, as generally described with respect to the method 180 of FIG. 9. Accordingly, a user may provide feedback via the surface control system 28 to control operation of the downhole device 12. As such, the surface control system 28 may transmit a restriction navigation feedback 250 (e.g., the processor 50 may receive the restriction navigation feedback) and provide the restriction navigation feedback as input for subsequent operations. Accordingly, at block 252, the processor 50 may modify operation of the downhole device 12 in accordance with the restriction navigation output and/or the restriction navigation feedback 250. For example, the processor 50 may output a control signal that causes an actuator to adjust one or more machine components of the downhole tractor device. Accordingly, the downhole device 12 may operate automatously (e.g., without receiving or using the input provided by the surface control system 28) or semi-automatously (e.g., using the input provided by the surface control system 28.

FIG. 16 shows a diagram 260 illustrating an example of a sequence of phases (e.g., operational phases) of the downhole device 12 with examples of time sequences for each phase. It should be noted that the durations (e.g., 10 s, 30 s, and the like) illustrated in the diagram 260 are meant to be illustrative and non-limiting. For example, each duration of a phase may be the same or different. In some embodiments, one or more of the durations may be less than 1 s, greater than 1 s, greater than 5 s, or greater than 10 s. As shown in the illustrated embodiments, the phases include a power up phase 262, a first calibration phase 264, a second calibration phase 266, a global mode selection phase 268, a lock-in window phase 270, and a band sampling phase 272. In general, measurements made during the first calibration phase 264 and/or the second calibration phase 266 may be used to determine calibration coefficients. In some embodiments, the processor 50 may transition from the first calibration phase to the second calibration phase based on a detected change in the current and/or voltage. For example, if the processor 50 detects the current exceeding a threshold, the processor 50 may proceed from the first calibration phase 264 to the second calibration phase 266. The calibration phase 266 may proceed for approximately 10 s, 20 s, up to the 30 s, or greater than 30 s. Similarly, if the processor 50 detects the current dropping below a threshold, the processor 50 may proceed from the second calibration phase 266 to the mode selection phase 268. During the mode selection phase 268, the processor 50 may not proceed to a subsequent phase until the processor 50 receives input indicating a selected global mode. Once the processor 50 determines the global mode, the processor 50 may utilize a band sampling algorithm in accordance with the selected global mode.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A downhole device, comprising:

one or more electrical property sensors configured to measure an electrical property of a power supply;

one or more processors; and one or more memory, wherein an operational command associated with a quantized electrical property is stored in the one or more memory, the one or more memory further comprising instructions stored on a non-transitory computer-readable medium and executable by the one or more processors to:

measure the electrical property of electrical power provided to the downhole device using the one or more electrical property sensors;

determine an expected range of the electrical property based on the measured electrical property;

convert the measured electrical property to the quantized electrical property when the measured electrical property is within the expected range; and modify an operation of the downhole device based on the operational command associated with the quantized electrical property.

2. The downhole device of claim 1, wherein the downhole device comprises a drilling tool.

3. The downhole device of claim 1, wherein modifying the operation of the downhole device comprises adjusting an actuator to modify a position of a machine component of the downhole device.

4. The downhole device of claim 1, wherein converting the measured electrical property comprises pre-processing the measured electrical property to remove electromagnetic interference from the measured electrical property.

5. The downhole device of claim 1, wherein the one or more memory is disposed within a housing of the downhole device.

6. The downhole device of claim 1, wherein the downhole device comprises a downhole tractor device.

7. The downhole device of claim 1, wherein modifying the operation of the downhole device comprises determining an operational state via a scripted state machine and a current operating state of the downhole device.

8. The downhole device of claim 1, wherein modifying the operation of the downhole device comprises identifying a set of changes in the electrical property that correspond to a downhole anomaly, a transmitted command from an external control system, or both.

9. The downhole device of claim 1, further comprising:

a plurality of extending arms, wherein modifying the operation of the downhole device includes modifying a position of the plurality of extending arms.

10. The downhole device of claim 1, wherein modifying the operation of the downhole device includes pausing movement of the downhole device.

11. A non-transitory computer-readable medium comprising computer-executable instructions that, when executed, are configured to cause a processor to:

receive a measured electrical property of electric power provided to a downhole device via a power supply, wherein the electrical property is measured by an electrical property sensor of the downhole device;

determine an expected range of the electrical property based on the measured electrical property;

convert the measured electrical property to a quantized electrical property when the measured electrical property is within the expected range;

determine which operational command of a plurality of operational commands is associated with the quantized electrical property, wherein the plurality of operational commands are stored on a memory associated with the downhole device;

provide the operational command associated with the quantized electrical property to a scripted state machine; and modify an operation of the downhole device, using the scripted state machine, based on the operational command associated with the quantized electrical property.

12. The non-transitory computer-readable medium of claim 11, wherein modifying the operation of the downhole device outputting an alert indicating the downhole device is stalled.

* * * * *